US011801684B2

(12) United States Patent
Franck

(10) Patent No.: US 11,801,684 B2
(45) Date of Patent: Oct. 31, 2023

(54) CIRCULATION APPARATUS FOR A LIQUID MIXTURE OF SUBSTANCES IN A CONTAINER

(71) Applicant: Jan Franck, Weidenberg (DE)

(72) Inventor: Jan Franck, Weidenberg (DE)

( * ) Notice: Subject to any disclaimer, the term of this patent is extended or adjusted under 35 U.S.C. 154(b) by 121 days.

(21) Appl. No.: 17/283,424

(22) PCT Filed: Oct. 8, 2019

(86) PCT No.: PCT/IB2019/058548

§ 371 (c)(1),
(2) Date: Apr. 7, 2021

(87) PCT Pub. No.: WO2020/075058

PCT Pub. Date: Apr. 16, 2020

(65) Prior Publication Data

US 2021/0347182 A1 Nov. 11, 2021

(30) Foreign Application Priority Data

Oct. 8, 2018 (DE) ..... 10 2018 007 916.4

(51) Int. Cl.
*B41J 2/175* (2006.01)

(52) U.S. Cl.
CPC ..... *B41J 2/17596* (2013.01)

(58) Field of Classification Search
CPC ..... B41J 2/18; B41J 2/175; B41J 2/19; B41J 2/17513; B41J 2/195; B41J 2/17596
See application file for complete search history.

(56) References Cited

U.S. PATENT DOCUMENTS

| | | | |
|---|---|---|---|
| 8,388,118 | B2 | 3/2013 | Hill |
| 8,833,915 | B2 | 9/2014 | Plummer |

FOREIGN PATENT DOCUMENTS

| | | |
|---|---|---|
| DE | 60011928 T2 | 8/2005 |
| DE | 102013110108 | 3/2015 |
| EP | 3339039 | 6/2018 |
| JP | H05-185600 | 7/1993 |

*Primary Examiner* — An H Do
(74) *Attorney, Agent, or Firm* — Pandiscio & Pandiscio

(57) ABSTRACT

The invention relates to an apparatus for circulating a liquid mixture of substances between a container and a pressure-sensitive component which is supplied from the container, including apparatus for circulating an ink between an ink storage container and a print head of a printing system, comprising a pump, which allows the liquid mixture of substances to circulate in the container through an external conduit circuit, a Venturi tube, the main conduit of which is connected into the external conduit circuit, and also a conduit which connects the output connection of the pressure-sensitive component to the suction connection of the Venturi tube.

18 Claims, 2 Drawing Sheets

Stand der Technik

CIRCULATION APPARATUS FOR A LIQUID MIXTURE OF SUBSTANCES IN A CONTAINER

REFERENCE TO PENDING PRIOR PATENT APPLICATION

This patent application claims benefit of International (PCT) Patent Application No. PCT/IB2019/058548, filed 8 Oct. 2019 by Fred Gabel for CIRCULATION APPARATUS FOR A LIQUID MIXTURE OF SUBSTANCES IN A CONTAINER, which claims benefit of German Patent Application No. DE 102018007916.4, filed 8 Oct. 2018.

The two (2) above-identified patent applications are hereby incorporated herein by reference.

FIELD OF THE INVENTION

The invention relates to an apparatus for circulating a liquid mixture of substances that is stocked in a container, for example a solution, emulsion or suspension, comprising a circulation pump, which allows the liquid mixture of substances in the container to circulate through an external conduit circuit, so that a separation is prevented within the container, even if a mechanical stirring device is not arranged in said container.

BACKGROUND OF THE INVENTION

Various liquids, in particular liquid mixtures of substances, therefore even inks for digital printing, are sometimes not stable, and pigments, dissolved substances, etc. can precipitate if the liquid is not kept permanently in motion—not just in a storage container, for example an ink reservoir, but also in a processing device, for example in a print head.

Stirrers are used in the prior art, for example in a laboratory, in order to prevent a separation of such liquid mixtures of substances.

Even in ink reservoirs there are these types of integrated stirrers, which keep the ink in continuous motion, as the attached FIG. 2 shows, which describes a typical prior art: In the context of a printing system 21, a print head 24 is supplied with ink 25 from an ink storage container 22 via a line 23. So that the ink 25 does not separate in the ink storage container 22, a stirrer 26 is provided there, the shaft 27 of which is guided outwardly through the housing 28 of the ink storage container 22. However, such a stirrer 26 is expensive, because most of the time the ink storage container 22 is supposed to have an airtight seal from the atmosphere, whereas the mechanism or the electrical equipment of the stirrer 26, i.e., the shaft 27 or cable, etc., must be led out of the ink storage container 22. A circulation of the ink 25 through the print head 24 is not foreseen in the process.

Therefore, magnetic stirrers were already provided for in JP H05-185600, i.e., magnetic bodies inside of an ink reservoir, which react to an externally applied magnetic field and rotate and thereby mix the ink. Apart from that, nevertheless every time an ink storage container is replaced, the magnetic bodies must be removed first and be inserted into a new ink storage container, which is extremely laborious.

DE 60011928 T2 describes another way; in this case, a stirrer inside an ink reservoir is dispensed with completely, and an ink circulation is provided instead, wherein a first of two tubes that discharge into the container is connected to the suction connection of a pump, the pressure connection of which is connected to the second tube. The ink is thereby kept constantly in circulation and a separation is prevented in this way so that a stirrer is no longer necessary.

However, none of these documents pursues the further issue of how the most uniform possible, temporally constant pressure can be maintained inside a pressure-sensitive component, in particular inside a print head, so that the print head prints with always the same quality.

In the case of printing systems that are currently available, attempts to this end are made either to install an actively operating pump device inside the inflow line of an ink print head or to install an actively operating suction device in the discharge line. However, this technology has not proven itself, because pump or suction devices can technically hardly be enabled to sustainably maintain a truly constant pressure difference, i.e., one that is free of pressure fluctuations or pressure waves.

On the other hand, attempts were already made to provide two ink reservoirs which were operated with different internal pressures so that a flow of ink comes about due to this pressure difference. However, this requires a constantly active pressure regulation in order to compensate for the empty volume above the liquid in the container that is increasing due to the ink consumption with a higher internal pressure and the empty volume that is decreasing at the same time in the other container.

There is also a variation wherein two ink reservoirs are provided with different heights or with different fill levels, whereby the pressure difference is caused by the different liquid levels. However, this requires a constantly active fill level regulation in order to compensate for the liquid volume in the upstream container that is decreasing due to the ink consumption and the liquid volume that is increasing at the same time in the other container.

Moreover, in both of these cases, two ink reservoirs are always required per print head or printing ink, which represents an increased space requirement. Furthermore, with such a system, actively changing the flow rate is only possible with difficulty, because fill levels and pressures in the containers cannot be changed easily without the print head dripping or air leaking, etc. Finally, these types of systems with ink reservoirs without circulation cannot be retrofitted easily since a standard ink reservoir without circulation has only a maximum of one heater and a full/empty display with a refill function; in the case of upgrading the printing system for a circulation with the use of two containers everything must be replaced as a result.

SUMMARY OF THE INVENTION

The disadvantages of the described prior art resulted in the problem which initiated the invention of further developing a generic circulation apparatus in such a way that a temporally constant pressure can always be maintained at the same time in the pressure-sensitive component, in particular in a print head.

The solution to this problem succeeds in the case of a generic circulation apparatus because of a Venturi tube, the main conduit of which is connected into the external conduit circuit; and also a line that connects the output connection of the pressure-sensitive component to the suction connection of the Venturi tube.

It is possible with such an arrangement to allow liquid, in particular ink, to circulate through a pressure-sensitive component, in particular through a print head; In the case of such a printing system, the ink flows virtually past the nozzles and is kept in continuous motion in order to prevent a precipitation of pigments, etc. At the same time, nozzle blockages from air bubbles can be prevented or eliminated because the small bubbles are further transported by means of the circulation, etc.

There are different print heads in the prior art; for example, those that require a flow of flow rate of 1-5 mL/min; others require a flow rate von 100-300 mL/min.

The circulation through the print head should be as pulseless as possible, in other words, a continuous flow of ink, because pump pulses or pressure pulses would lead to the head dripping or to the intake of air due to the inertia of the ink, and result in the print head no longer printing properly. As a result, a pump that is as pulseless as possible is required, e.g., a membrane pump or propeller pump, and a Venturi tube with a suction connection. Said pump pumps from the ink reservoir in a cycle back into the ink reservoir; as a result, the ink is in continuous motion, and it is possible to dispense with a stirrer.

A Venturi tube, which is connected to the circulation output of the print head, is attached at the location at which the ink is pumped out of the pump back into the reservoir. By means of this Venturi tube, ink is suctioned through the print head continuously and almost pulselessly and in doing so lands back in a container; preferably in the same container, which also supplies the print head with ink. By adjusting the conveyance capacity of the pump used, and/or by using different Venturi tubes and/or flow rate restrictors it is possible to achieve any desired circulation rates.

Because of the arrangement according to the invention, it is possible to dispense with an active negative pressure or dispense with a negative pressure control in the ink reservoir, as long as the suction pressure of the Venturi tube is adequate for the print head, in particular if the ink reservoir is arranged above the print head.

The system according to the invention is very small, is able to be retrofitted at any time, is simple to control and implement, and requires as good as no monitoring.

In the process, it is irrelevant whether the liquid circulates in a small container or is returned to a larger one, etc.

Of course, a degassing unit can also be provided in the container, and/or a filter, and/or a heater, etc.

It has proven to be advantageous that the external conduit circuit is not closed via the pressure-sensitive component, rather is closed directly, i.e., constitutes virtually a bypass to the pressure-sensitive component. As a result, the mixing process inside the storage and supply container is completely decoupled from the operation of the pressure-sensitive component, in particular of a print head.

For this very reason, the conduit circuit between the storage and/or supply container and the pressure-sensitive component should also not be closed via the circulation pump, but constitute a bypass to the circulation pump.

Furthermore, it has been proven that the main conduit of the Venturi tube is connected downstream of the circulation pump into the conduit circuit thereof. Therefore, the two circuits—the circuit of the circulation pump, on the one hand, and the circuit of the pressure-sensitive component, on the other hand—first unite in the Venturi tube and flow back from there jointly to the container. Apart from this flow union, the two flows are decoupled to the greatest possible extent so that any pressure fluctuations caused by the circulation pump despite all countermeasures are not able to reach the pressure-sensitive component.

The pressure-sensitive component is supplied at the input connection thereof directly from the container; ideally, a pump device is not required for this, rather a simple line connection suffices; even a pressure gradient, such as could be produced by an elevated arrangement of the container with respect to the print head, is not required.

In fact the pressure gradient required for the formation of a flow pressure gradient is produced by the Venturi tube, which generates a negative pressure at the suction connection thereof. In other words, the flow inside the circuit closed via the pressure-sensitive component is maintained only via a pressure gradient, which can be attributed to the suction power of the Venturi tube.

In that a return line from the pressure-sensitive component to the container is switched via the Venturi tube, the circuit closes through the pressure-sensitive element, and unused liquid returns to the container, where it is immediately available for a subsequent use.

If the circuit that is closed via the pressure-sensitive component is free of pumps, an optimally uniform pressure gradient is yielded via the pressure-sensitive component so this experiences optimum operating conditions.

A non-return valve can be provided in the suction line between the output connection of the pressure-sensitive component and the suction connection of the Venturi tube, which non-return valve prevents a reverse flow to the output connection of the pressure-sensitive. As a result, a flow reversal within the pressure-sensitive component is ruled out completely, even if the circulation pump were to fail.

Furthermore, there is the possibility of providing a reducing device in the suction line between the output connection of the pressure-sensitive component and the suction connection of the Venturi tube in order to limit the flow quantity from the output connection of the pressure-sensitive component. As a result, it is possible to individually adjust the circulation rate to the requirements of the pressure-sensitive component.

Such a reducing device is preferably embodied as an adjustable reducing valve, so that the circulation rate through the pressure-sensitive component can be readjusted at any time.

It is within the scope of the invention that the inlet and outlet lines discharge at the storage or supply container in the region of the housing base thereof, so that a circulation can be maintained as long as there is still enough liquid in the container that the discharge of the outlet line does not dry out.

Because a stirrer is not required in the storage container, the storage container is able to be free of movable elements in the interior. As a result, the ink reservoir can also be embodied as a replaceable multi-use or disposable container and can be replaced quickly at any time so that the printing process only has to be interrupted briefly.

Furthermore, the invention recommends that a continuously conveying pump be used as a circulation pump, for example a membrane pump or propeller pump. The fewer the pressure fluctuations such a pump generates, the less the operation of the pressure-sensitive component is affected.

Finally, it corresponds to the teaching of the invention that the container is an ink storage container, and/or that the pressure-sensitive component is an ink print head. The invention can be used with particular advantage in printing systems, because for the most part, a high consistency of the pressure gradient via the ink print head is required there in order to achieve optimal printing results.

BRIEF DESCRIPTION OF THE DRAWINGS

Additional features, details, advantages and effects based on the invention are yielded from the following description of a preferred embodiment of the invention as well as on the basis of the drawing, which shows.

DETAILED DESCRIPTION OF THE PREFERRED EMBODIMENTS

Figure 1:
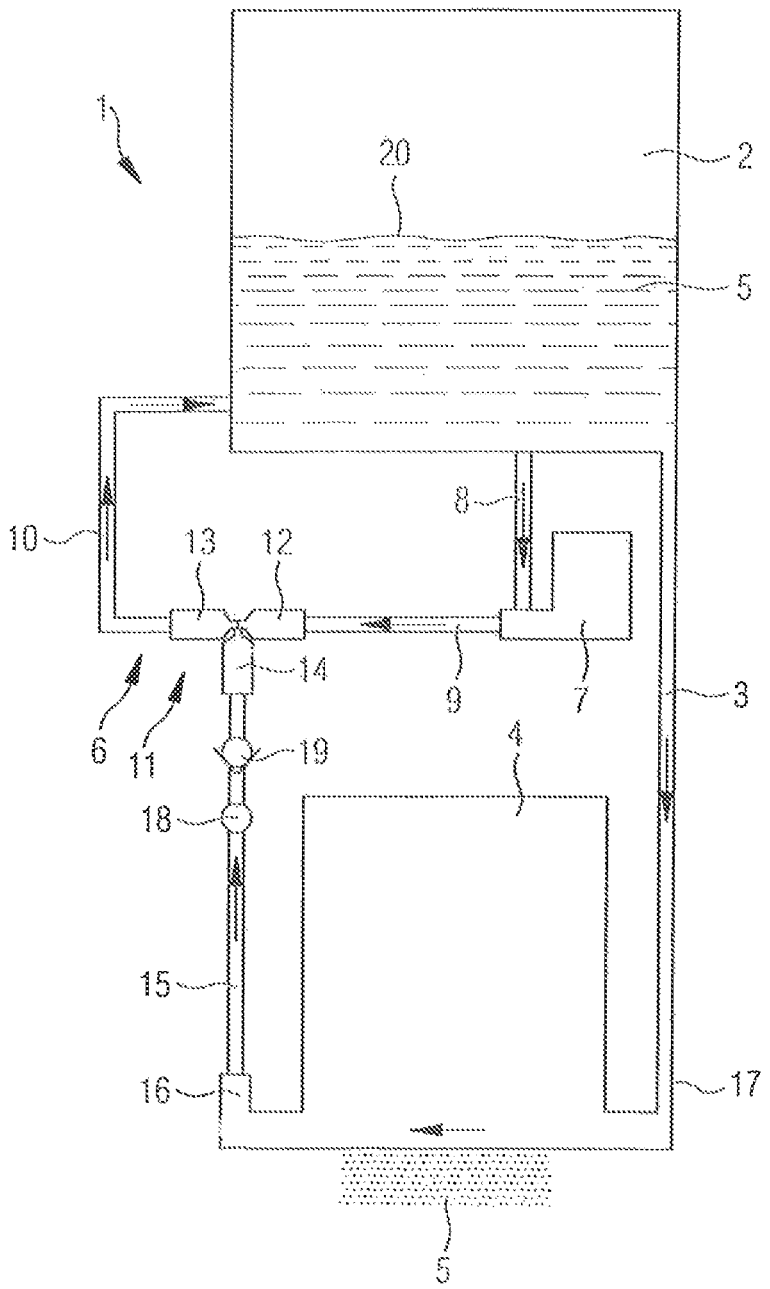
FIG. 1 A schematic tubing plan of an ink printing system according to the invention.
Figure 2:
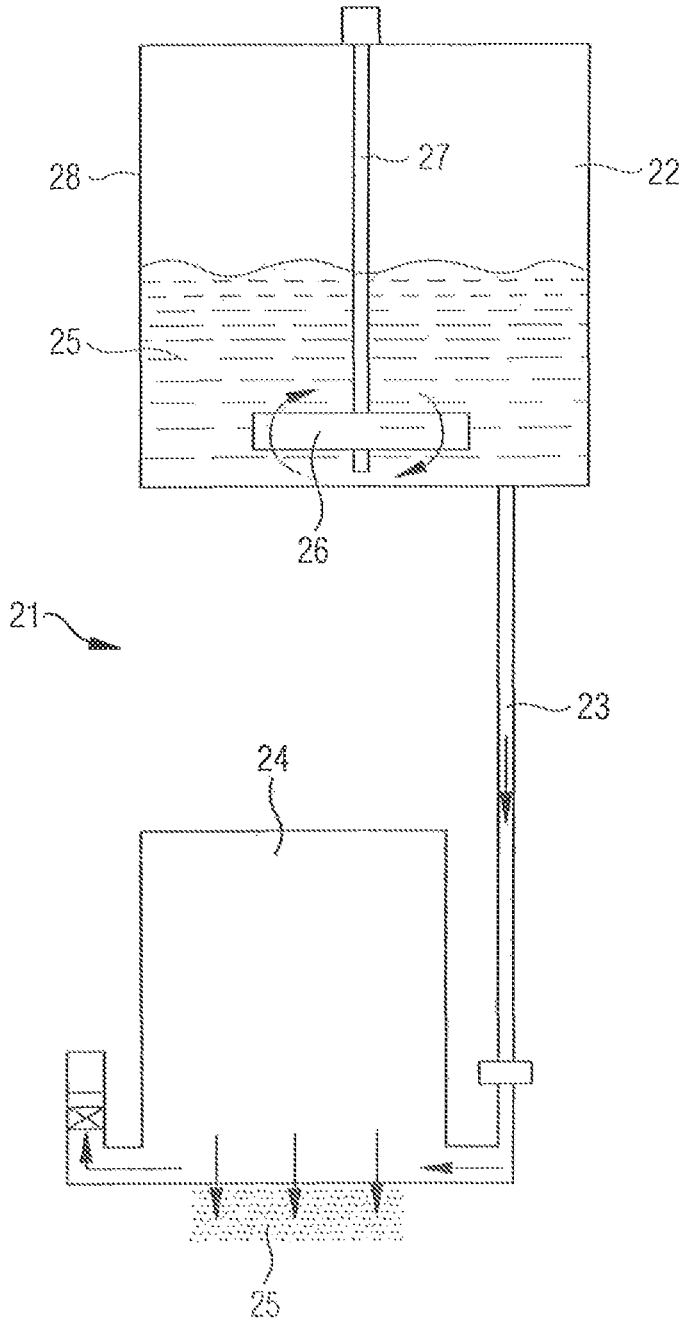
FIG. 2 An ink printing system according to the prior art.

As a part of a printing system 1 according to the invention, an ink storage container 2 is provided, which supplies a print head 4 with ink 5 via a line 3.

However, a stirring mechanism is not provided in the ink storage container 2. Instead, a separation of the ink 5 is prevented in that said ink is kept in continuous motion via an external circuit 6. A circulation pump 7 is used for this, which pump is connected via the suction line 8 thereof as well as via the pressure conduit 9, 10 thereof respectively with the ink storage container 2 so that the ink 5 circulates through the external circuit 6.

In the pressure conduit 9, 10 of the circulation pump 7, in other words, downstream of same, a Venturi tube 11 is connected in so that the ink 5 circulating in the circuit 6 flows through it.

The Venturi tube 11 consists of a smooth-walled tube piece, the inner lumen of which narrows at a point in the cross section, for example to 90% of the normal internal cross section of the tube or less, preferentially to 80% of the normal internal cross section of the tube or less, preferably to 60% of the normal internal cross section of the tube or less, in particular to 40% of the normal internal cross section of the tube or less, or even to 30% of the normal internal cross section of the tube or less. Even greater narrowings are conceivable, for example to 25% of the normal internal cross section of the tube or less, preferentially to 20% of the normal internal cross section of the tube or less, preferably to 15% of the normal internal cross section of the tube or less, in particular to 10% of the normal internal cross section of the tube or less.

The narrowing of the cross section of the Venturi tube 11 can be effectuated for example by two opposing tube segments 12, 13, which are conical or which taper in another manner from the peripheral ends thereof towards the other ends thereof that face each other, and which are connected to each other at the point of the smallest diameter thereof. At this point, a third lateral connection 14 is provided, at which a negative pressure is applied during the operation of the Venturi nozzle 11, and which therefore should be designated as a suction connection 14.

The Venturi tube 11 preferably has no other openings besides the peripheral discharges of its two tube segments 12, 13 and the suction connection 14, in other words, in the interior space, it is independent of the surrounding atmospheric pressure.

The Venturi tube 11 should consist of a solid material, such as for example metal or a solid structurally stable plastic so that it is not deformed under the influence of a pressure difference between the external and interior space.

In addition, the sheath of the Venturi tube 11 should be both liquid-tight so that no ink can escape, as well as gas-tight so that so, in the case of an internal negative pressure, neither air nor other gas can diffuse into the interior space.

A further special feature of the invention is that the central, tapered region of the Venturi tube 11 should preferably lie at the same level as the two tube segments 12, 13. This can be effectuated for example in that the Venturi tube. 11 is aligned horizontally as shown in FIG. 1.

The peripheral ends of the conical tube segments 12, 13 are connected into the pressure conduit 9, 10 of the circulation pump 7 and form the main conduit of the Venturi nozzle or of the Venturi tube 11. The suction connection 14 of the Venturi tube is connected via a suction line 15 with the outlet side connection 16 of the print head 4 so that the negative pressure with respect to the normal operating pressure at the inlet side connection 17 of the print head 4 causes a pressure difference, which results in a flow.

In order to be able to adjust this pressure difference precisely to the value required by the print head 4 in question, a reducing device can be connected into the suction line 15. In doing so, this can be an adjustable reducing valve 18.

Furthermore, the invention provides that a non-return valve 19 still be connected into the suction line 15 in order to prevent a backflow of ink in the suction line 15, even if the circulation pump 7 is turned off or fails.

Because the pressure difference $p_\Delta$ via the print head 4 from the height of the liquid level 20 of the ink 5 is in the ink storage and/or supply container 2, this container 2 can be operated without refilling as long as the lines 3, 8 do not dry out.

The Bernoulli equation applies to the Venturi tube 11, wherein the index 1 refers to the parameters in the inlet connection or the tube segment 12, and index 2 refers to the parameters in the suction connection 14:

$$(p_1-p_2)+p*g*(h_1-h_2)=\tfrac{1}{2}*p*v_2^{2}*[1-(A_2/A_1)^2],$$

wherein p is the pressure at the respective location, h is the height at the respective location, A is the clear flow cross section at the respective location, v is the flow rate at the respective location, and p is the density of the ink and g is the gravitational acceleration, or:

$$p_2-=p_1*g*(h_1-h_2)-\tfrac{1}{2}*p*v_2^{2}*[1-(A_2/A_1)^2];$$

$$p_2=p_1+p*g*(h_1-h_2)-\tfrac{1}{2}*p*v_2^{2}*[1-(A_2/A_1)^2].$$

If the height difference $(h_1-h_2)$ is negligibly small, in other words, in particular if the Venturi tube 11 is aligned horizontally or if the dimensions thereof are small, the formula is simplified to:

$$p_2=p_1-\tfrac{1}{2}*p*v_2^{2}*[1-(A_2/A_1)^2],$$

In the following, it should be assumed that the density p of the ink is approximately 1 kg/dm$^3$.

Furthermore, is can be assumed that the pressure $p_1$ in the case of a running circulation pump 7 is greater than the weight pressure $p_t$ at the base of the ink storage container 2 and also greater than the surrounding atmospheric pressure $p_a$. In particular, the following applies with the pressure increase $p_z$ stemming from the power of the circulation pump 7:

$$p_1=p_t+p*g*(h_t-h_1)+p_z.$$

The weight pressure $p_d$ at the inlet side connection 17 of the print head 4 is a function of the height $h_d$ of the inlet side connection 17 of the print head 4 in proportion to the height $h_t$ of the outlet at the base of the ink storage container 2:

$$p_d=p_t+p*g*(h_t-h_d).$$

However, a negative pressure $p_2$ should be applied at the suction connection 14, such that at the outlet side connection 16 of the print head 4, a negative pressure $p_\Delta<0$ prevails with respect to the weight pressure $p_d$ at the inlet side connection 17 of the print head 4:

$$p_2=p_d+p_\Delta=p_t+p*g*(h_t-h_d)+p_\Delta,$$

and specifically reduced by more than the difference $p*g*(h_2-h_d)$:

$$p_2+p*g*(h_2-h_d)=p_d+p_\Delta=p_t+p*g*(h_t-h_d)+p_\Delta,$$

In other words:

$$p_2+\rho*g*(h_2-h_d)=p_t+\rho*g*(h_t-h_d)+p_\Delta,$$

$$p_2=p_t+\rho*g*(h_t-h_d)-\rho*g*(h_2-h_d)+p_\Delta,$$

$$p_2=p_t+\rho*g*(h_t-h_2)+p_\Delta.$$

$$p_2=p_1-\frac{1}{2}*\rho*v_2^2*\left[1-\left(\frac{A_2}{A_1}\right)^2\right]=p_1+\rho*g*(h_t-h_2)+p_\Delta.$$

$$p_2=p_t+\rho*g*(h_t-h_1)+p_z-\frac{1}{2}*\rho*v_2^2*\left[1-\left(\frac{A_2}{A_1}\right)^2\right]==p_t+\rho*g*(h_t-h_2)+p_\Delta.$$

If $h_1\approx h_2$ is, the following applies:

$$p_2\approx p_t+\rho*g*(h_t-h_2)+p_z-\frac{1}{2}*\rho*v_2^2*\left[1-\left(\frac{A_2}{A_1}\right)^2\right]==p_t+\rho*g*(h_t-h_2)+p_\Delta.$$

$$p_z-\frac{1}{2}*\rho*v_2^2*\left[1-\left(\frac{A_2}{A_1}\right)^2\right]=p_\Delta.$$

$$\frac{1}{2}*\rho*v_2^2*\left[1-\left(\frac{A_2}{A_1}\right)^2\right]=p_z-p_\Delta.$$

$$v_2^2*\left[1-\left(\frac{A_2}{A_1}\right)^2\right]=2*\frac{(p_z+|p_\Delta|)}{\rho}.$$

$$v_1^2*\left(\frac{A_1}{A_2}\right)^2*\left[1-\left(\frac{A_2}{A_1}\right)^2\right]=(p_z+|p_\Delta|)*\frac{2}{\rho}.$$

$$v_1^2*\left[\left(\frac{A_1}{A_2}\right)^2-1\right]=(p_z+|p_\Delta|)*\frac{2}{\rho}.$$

$$\left[\left(\frac{A_2}{A_1}\right)^2-1\right]=(p_z+|p_\Delta|)*\frac{2}{(\rho*v_1^2)}.$$

Accordingly, the cross-section relationship $(A_1/A_2)$ between the inlet 12 of the Venturi tube 11 and the suction connection 14 thereof can be determined in accordance with the above formula from the pump pressure $p_z$ of the circulation pump 7, the desired pressure difference $p_\Delta$ via the print head 4 and the flow rate $v_1$ in the supply line 12 taking the density p of the ink into account.

Various modifications of the arrangement according to the invention are possible. In particular, various valves and/or cross section reductions can respectively also be inserted at another location of the circuit in question. In addition, according to this principle, a plurality of print heads of a printing system can also be connected to a common Venturi tube or every print head is connected to a separate Venturi tube.

| List of Reference Numbers | |
|---|---|
| 1 | Printing system |
| 2 | Ink storage container |
| 3 | Line |
| 4 | Print head |
| 5 | Ink |
| 6 | Circuit |
| 7 | Circulation pump |
| 8 | Suction line |
| 9 | Pressure conduit |
| 10 | Pressure conduit |
| 11 | Venturi tube |
| 12 | Inlet side tube segment |
| 13 | Outlet side tube segment |
| 14 | Suction connection |
| 15 | Suction line |
| 16 | Outlet side connection |
| 17 | Inlet side connection |
| 18 | Reducing valve |
| 19 | Non-return valve |
| 20 | Liquid level |
| 21 | Printing system |
| 22 | Ink storage container |
| 23 | Line |
| 24 | Print head |
| 25 | Ink |
| 26 | Stirrer |
| 27 | Shaft |
| 28 | Housing |

The invention claimed is:

1. An apparatus for circulating a liquid mixture of substances (5) that is stocked in a container (2), comprising a circulation pump (7), which allows the liquid mixture of substances (5) to circulate in the container (2) through an external conduit circuit (6), so that a separation is prevented within the container (2), even if a mechanical stirring device is not arranged in said container; and further comprising:

a) a Venturi tube (11), the main conduit of which (12, 13) is connected into the external conduit circuit (6); and b) a line (15) which connects an output connection (16) of the pressure-sensitive component (4) to the suction connection (14) of the Venturi tube (11), characterized in that the circuit closed via the pressure-sensitive component (4) is free of pumps.

2. The apparatus according to claim 1, characterized in that the external conduit circuit (6) is not closed via the pressure-sensitive component (4), rather is closed directly, i.e., constitutes virtually a bypass to the pressure-sensitive component (4).

3. The apparatus according to claim 1, characterized in that the conduit circuit between the container (2) and the pressure-sensitive component (4) is not closed via the circulation pump (7), but constitutes a bypass to the circulation pump (7).

4. The apparatus according to claim 1, characterized in that the main conduit (12, 13) of the Venturi tube (11) is connected downstream of the circulation pump (7) into the external conduit circuit (6).

5. The apparatus according to claim 4, characterized in that the main conduit (12, 13) of the Venturi tube (11) is connected into the pressure conduit (9, 10) of the circulation pump (7).

6. The apparatus according to claim 1, characterized in that the pressure-sensitive component (4) is supplied at the input connection (17) thereof from the container (2).

7. The apparatus according to claim 1, characterized in that a return line from the pressure-sensitive component (4) to the container (2) is switched via the Venturi tube (11).

8. The apparatus according to claim 1, characterized in that the flow within the circuit closed via the pressure-sensitive component (4) is maintained only via a pressure gradient, which can be attributed to the suction power of the Venturi tube (11).

9. The apparatus according to claim 1, characterized in that a non-return valve (19) is provided in the suction line (15) between the output connection (16) of the pressure-sensitive component (4) and the suction connection (14) of the Venturi tube (11), which non-return valve prevents a reverse flow to the output connection (16) of the pressure-sensitive component (4).

10. The apparatus according to claim 1, characterized in that a reducing device is provided in the suction line (15) between the output connection (16) of the pressure-sensitive component (4) and the suction connection (14) of the Venturi tube (11), in order to limit the flow quantity from the output connection (16) of the pressure-sensitive component (4).

11. The apparatus according to claim 10, characterized in that the reducing device is embodied as an adjustable reducing valve (18).

12. The apparatus according to claim 1, characterized in that the inlet and/or outlet line(s) (3, 8, 10) discharge(s) at the storage container (2) in the region of the housing base thereof.

13. The apparatus according to claim 1, characterized in that a stirrer is not arranged in the storage container (2), rather that the storage container (2) is free of movable elements in the interior.

14. The apparatus according to claim 1, characterized in that the circulation pump (7) is a continuously conveying pump.

15. The apparatus according to claim 14, characterized in that the circulation pump (7) comprises a membrane pump or propeller pump.

16. The apparatus according to claim 1, characterized in that the container (2) is an ink storage container.

17. The apparatus according to claim 1, characterized in that the pressure-sensitive component (4) is an ink print head.

18. The apparatus according to claim 1, characterized in that the liquid mixture of substances (5) that is stocked in the container (2) comprises at least one from the group consisting of a solution, an emulsion and a suspension.

* * * * *